US012012949B2

(12) United States Patent
Iwata

(10) Patent No.: US 12,012,949 B2
(45) Date of Patent: Jun. 18, 2024

(54) DIAPHRAGM PUMP

(71) Applicant: TACMINA CORPORATION, Osaka (JP)

(72) Inventor: Daiki Iwata, Hyogo (JP)

(73) Assignee: TACMINA CORPORATION, Osaka (JP)

( * ) Notice: Subject to any disclaimer, the term of this patent is extended or adjusted under 35 U.S.C. 154(b) by 219 days.

(21) Appl. No.: 17/637,594

(22) PCT Filed: Aug. 25, 2020

(86) PCT No.: PCT/JP2020/032075
§ 371 (c)(1),
(2) Date: Feb. 23, 2022

(87) PCT Pub. No.: WO2021/039807
PCT Pub. Date: Mar. 4, 2021

(65) Prior Publication Data

US 2022/0275797 A1 Sep. 1, 2022

(30) Foreign Application Priority Data

Aug. 27, 2019 (JP) ..... 2019-154441

(51) Int. Cl.
*F04B 43/02* (2006.01)
*F04B 43/00* (2006.01)

(52) U.S. Cl.
CPC ..... *F04B 43/02* (2013.01); *F04B 43/0054* (2013.01)

(58) Field of Classification Search
CPC ..... F04B 43/02; F04B 43/04; F04B 43/09; F04B 43/0054; F04B 45/04; F04B 45/047; F16J 3/02
See application file for complete search history.

(56) References Cited

U.S. PATENT DOCUMENTS 4,951,554 A * 8/1990 Scott ..... F16J 3/02 92/103 SD
2003/0110939 A1* 6/2003 Able ..... F04B 43/0054 92/98 R
2013/0343909 A1 12/2013 Nitta
(Continued)

FOREIGN PATENT DOCUMENTS

CN 87200989 U 4/1988
CN 103097730 A 5/2013
JP S54122107 U 8/1979
(Continued)

*Primary Examiner* — Kenneth J Hansen
(74) *Attorney, Agent, or Firm* — The Webb Law Firm

(57) ABSTRACT

Provided is a diaphragm pump including: a diaphragm that forms a part of a wall part of a pump chamber having a space for housing liquid to be delivered and that is elastically deformable to reciprocate in an inward and outward direction relative to the pump chamber; and a drive unit for elastically deforming the diaphragm toward the inner side in the inward and outward direction. The diaphragm has a lower dead point located inward of a neutral position in the inward and outward direction, in which the diaphragm is not elastically deformed at the neutral position. The drive unit is configured to support the diaphragm on an outer side in the inward and outward direction when the diaphragm lies at the lower dead point after reaching the lower dead point.

1 Claim, 13 Drawing Sheets

(56) References Cited

U.S. PATENT DOCUMENTS

2017/0306935 A1* 10/2017 Fujiwara ..... F04B 43/026

FOREIGN PATENT DOCUMENTS

| | | | |
|---|---|---|---|
| JP | H05263764 | A | 10/1993 |
| JP | H777161 | A | 3/1995 |
| JP | 2014206158 | A | 10/2014 |
| JP | 2018197509 | A | 12/2018 |

* cited by examiner

DIAPHRAGM PUMP

CROSS-REFERENCE TO RELATED APPLICATIONS

This application is the United States national phase of International Application No. PCT/JP2020/032075 filed Aug. 25, 2020, and claims priority to Japanese Patent Application No. 2019-154441 filed Aug. 27, 2019, the disclosures of which are hereby incorporated by reference in their entirety.

BACKGROUND OF THE INVENTION

Field of the Invention

The present invention relates to a diaphragm pump for liquid delivery.

Description of Related Art

As disclosed in, for example, Patent Literature 1, a diaphragm pump includes an elastically deformable diaphragm that is disposed to have one surface side exposed to the inside of a pump chamber (a suction and delivery chamber in Patent Literature 1), and a pump body that is configured to move the diaphragm by elastically deforming the diaphragm in an inward and outward direction relative to the pump chamber.

The pump body is configured to repeat a motion of pressing the diaphragm toward the inside of the pump chamber and a motion of pulling the diaphragm toward the outside of the pump chamber, and thereby deliver the liquid.

Meanwhile, the diaphragm of the conventional diaphragm pump comes into a state where it bulges toward the outside of the pump chamber when the diaphragm is pulled outward and reaches a lower dead point by the pump body. Therefore, when the internal pressure of the pump chamber is high, there is a case where the diaphragm receives the pressure inside the pump chamber and is deformed outside in the inward and outward direction further beyond the lower dead point. If the deformation of the diaphragm into the inside of the pump chamber is suppressed by the internal pressure of the pump chamber in such a case, a discharge amount of the liquid to be delivered is decreased, which is problematic.

CITATION LIST

Patent Literature

Patent Literature 1: JP 2018-197509 A

SUMMARY OF THE INVENTION

Technical Problem

In view of the above circumstances, it is an object of the present invention to provide a diaphragm pump that is capable of improving a liquid discharge efficiency.

Solution to Problem

A diaphragm pump of the present invention includes: a diaphragm that forms a part of a wall part of a pump chamber having a space for housing liquid to be delivered and that is elastically deformable to reciprocate in an inward and outward direction relative to the pump chamber; and a drive unit for elastically deforming the diaphragm toward the inner side in the inward and outward direction, wherein the diaphragm has a lower dead point located inward of a neutral position in the inward and outward direction, in which the diaphragm is not elastically deformed at the neutral position, and the drive unit is configured to support the diaphragm on an outer side in the inward and outward direction when the diaphragm lies at the lower dead point after reaching the lower dead point.

The diaphragm pump of the present invention can be configured such that the diaphragm is configured to move toward an upper dead point by being pressed toward the inner side in the inward and outward direction by the drive unit, and move toward the lower dead point by elastic recovery due to the elastic force of the diaphragm itself.

DESCRIPTION OF THE INVENTION

Hereinafter, a description will be given for a diaphragm pump according to one embodiment of the present invention with reference to the accompanying drawings.

The diaphragm pump according to this embodiment is configured to deliver a certain amount of liquid at every certain time interval.

Figure 1:
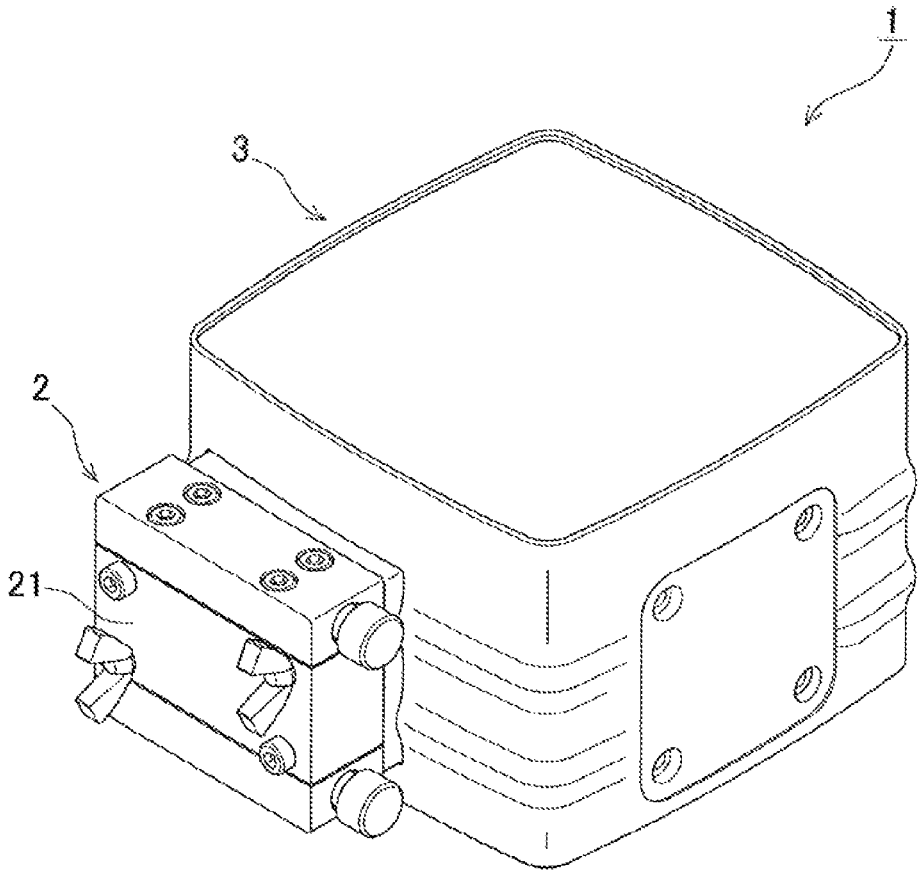
FIG. 1 is a perspective view of a diaphragm pump according to one embodiment of the present invention.
Figure 2:
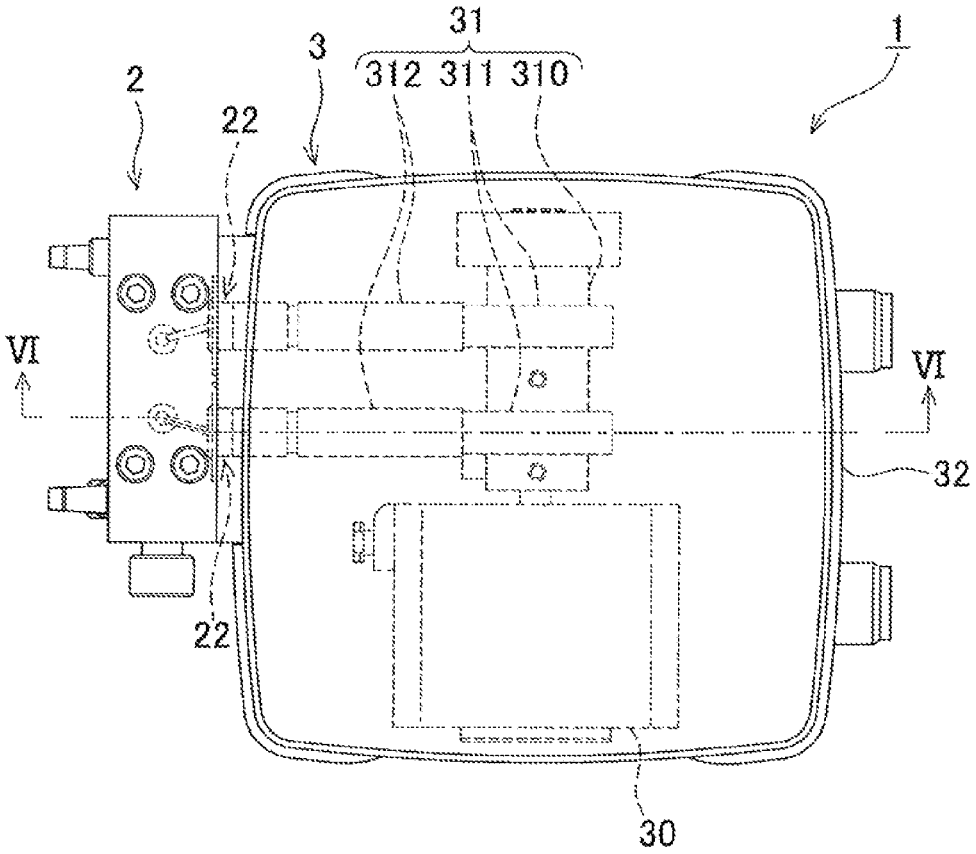
FIG. 2 is a plan view of the diaphragm pump according to the embodiment.

As shown in FIG. 1 and FIG. 2, a diaphragm pump 1 includes a head unit 2 that includes a pump chamber 20 (see FIG. 6) that is configured to temporarily store the liquid to be delivered and has a variable volume (variable extent of an internal space), and a drive unit 3 that transmits a power for varying the volume of the pump chamber 20 to the pump head 2.

Figure 6:
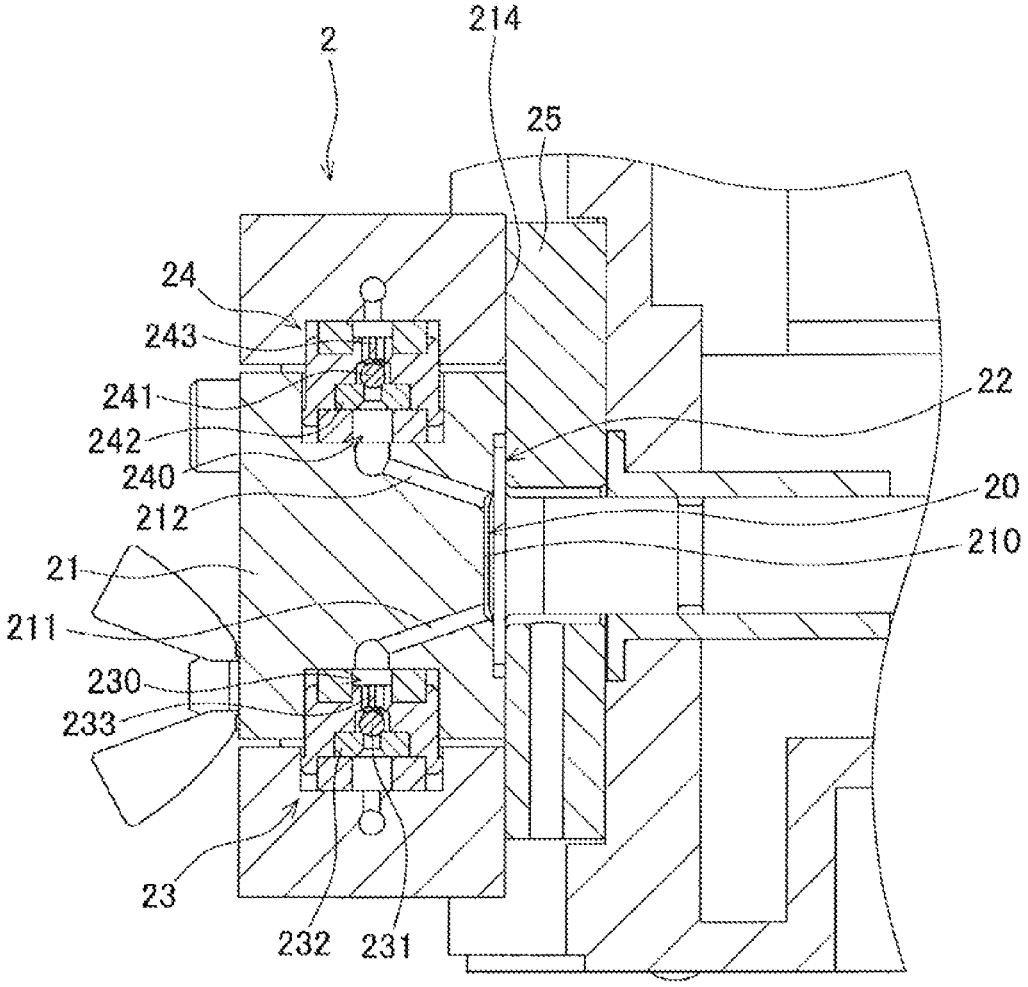
FIG. 6 is a cross section taken along a line VI-VI in FIG. 2.

As shown in FIG. 6, the pump head 2 includes a non-deformable fixed wall part 210 that forms a wall part of the pump chamber 20, a pump head 21 that has a suction-side fluid passage 211 through which liquid sucked into the pump chamber 20 flows, and a discharge-side fluid passage 212 through which liquid discharged from the pump chamber 20 flows, a diaphragm 22 that, together with the fixed wall part 210, forms the pump chamber 20, a suction-side valve mechanism 23 that opens and closes the suction-side fluid passage 211, a discharge-side valve mechanism 24 that opens and closes the discharge-side fluid passage 212, and a spacer 25 that is disposed between the pump head 21 and the drive unit 3 (see FIG. 6).

Figure 3:
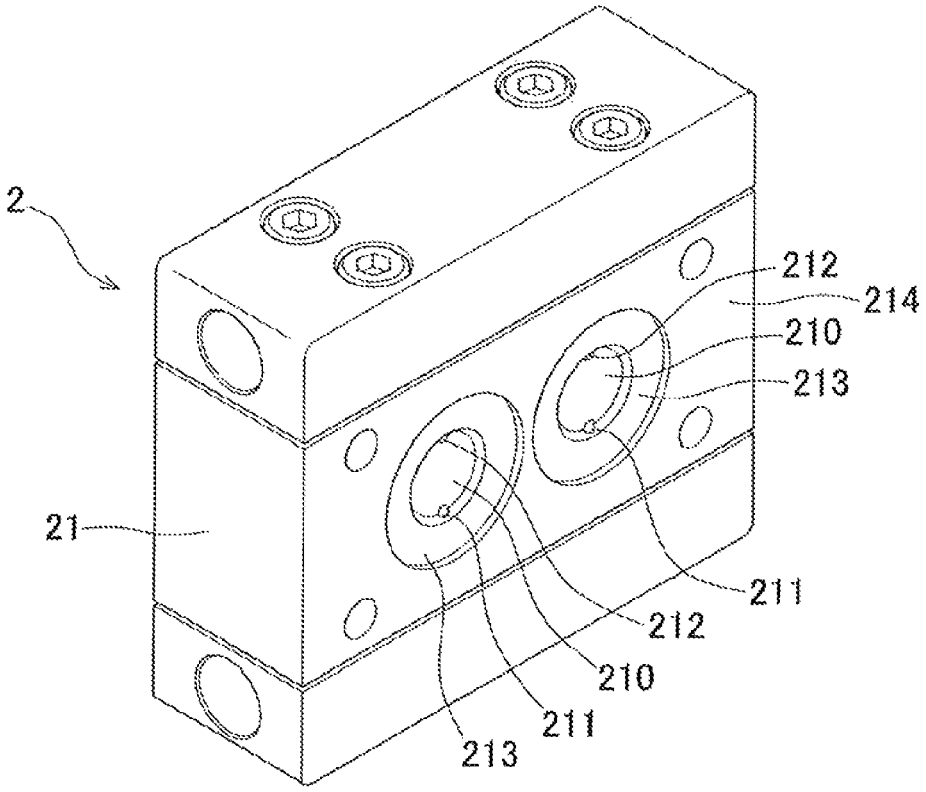
FIG. 3 is a perspective view of a head unit according to the embodiment.

As shown in FIG. 3, the pump head 21 includes arrangement parts 213 each of which is configured to arrange the diaphragm 22 therein, in addition to the fixed wall part 210, the suction-side fluid passage 211, and the discharge-side fluid passage 212 for each of the arrangement parts 213 (see FIG. 6).

An outer surface of the pump head 21 includes a contact surface 214 that is brought into contact with the spacer 25 (see FIG. 6). The fixed wall part 210 and the arrangement parts 213 are formed in this contact surface 214.

The fixed wall part 210 has a recessed shape with a flat bottom surface. The bottom surface of the fixed wall part 210 has a circular shape as viewed from the front side.

The arrangement part 213 is formed to extend outward from the entire periphery of the fixed wall part 210 and has an annular shape as viewed from the front side. The arrangement part 213 also has a flat bottom surface. The contact surface 214, the arrangement part 213, and the fixed wall part 210 are formed integral with each other to have a stepped shape.

Figure 7:
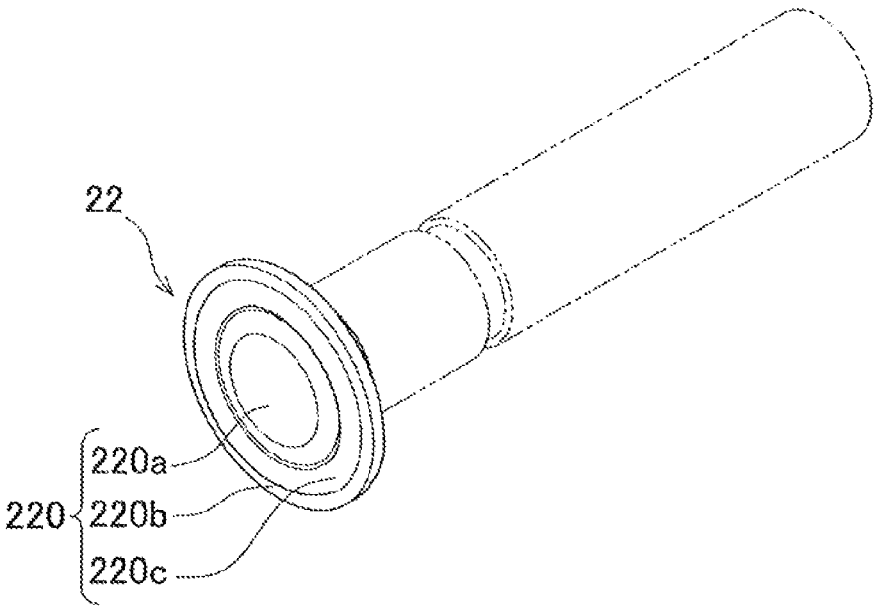
FIG. 7 is a perspective view of the diaphragm according to the embodiment.
Figure 8:
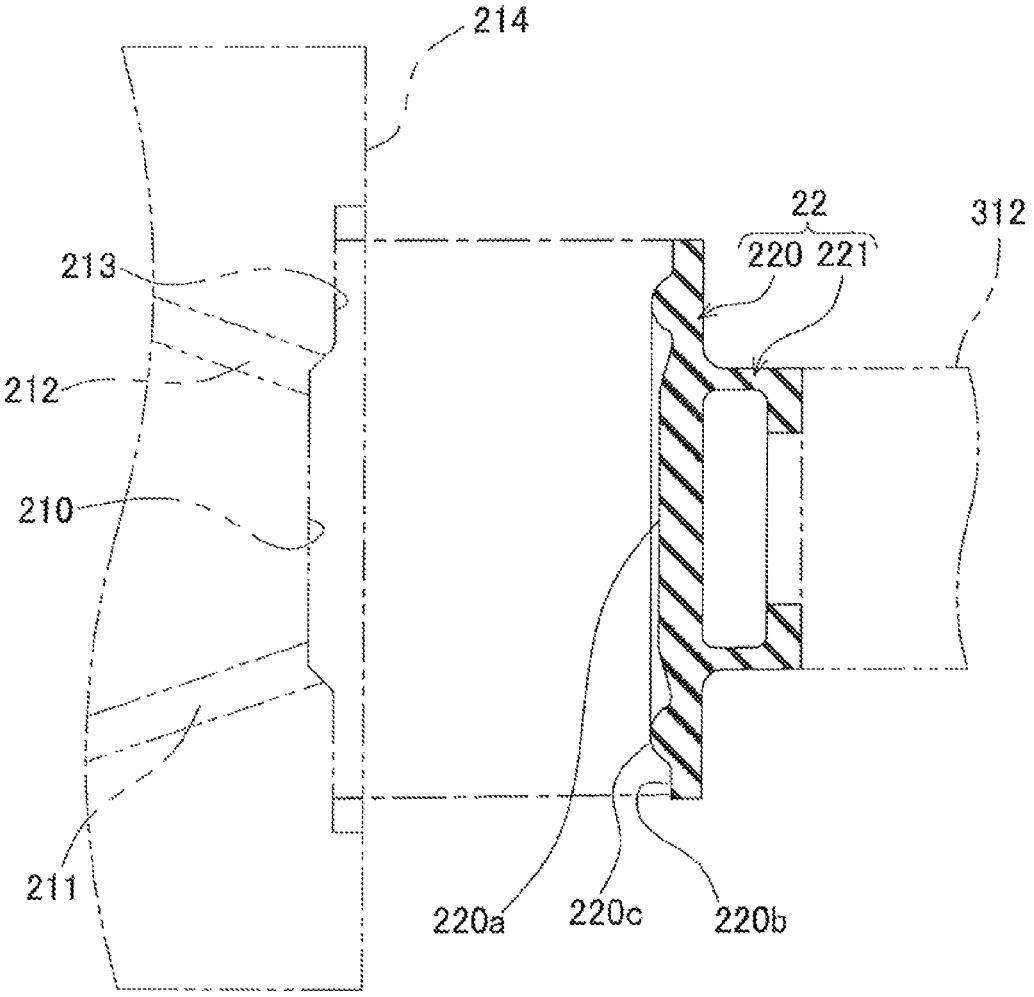
FIG. 8 is an enlarged view of the vertical cross section of the diaphragm according to the embodiment.

The diaphragm 22 has a plate-shaped elastic diaphragm body 220 as shown in FIG. 7, and a connection part 221 for connection between the diaphragm body 220 and the drive unit 3 (later-described shaft 312) as shown in FIG. 8. The diaphragm 22 is formed of a resin, and the diaphragm body 220 and the connection part 221 are integrally molded.

As shown in FIG. 7, the diaphragm body 220 has a circular shape as viewed from the front side.

The diaphragm 22 of this embodiment includes a deformable part 220*a* that is located opposite to the fixed wall part 210 with a space therebetween, an annular edge part 220*b* that extends outward from the entire periphery of the deformable part 220*a* and is disposed in the arrangement part 213 (see FIG. 8), and a seal part 220*c* that projects from one side of the annular edge part 220*b* (the side arranged to face the arrangement part 213).

The deformable part 220*a* is located opposite to the fixed wall part 210 with a space therebetween.

The annular edge part 220*b* is configured to be pinched between the arrangement part 213 and the spacer 25 so that the diaphragm 22 is configured to be fixed to the arrangement part 213.

Thus, the diaphragm 22 is configured such that the deformable part 220*a* is deformed in an approaching and separating direction in which it moves toward and away from the fixed wall part 210 (i.e., the inward and outward direction with respect to the pump chamber 20) with the annular edge part 220*b* securely positioned. In the diaphragm 22 of this embodiment, the deformable part 220*a* is elastically deformed to entirely bulge toward the fixed wall part 210, and returns to the original shape due to the elastic recovery to move away from the fixed wall part 210. Thus, the deformable part 220*a* is configured to reciprocate relative to the fixed wall part 210.

When the deformable part 220*a* moves in a direction approaching the fixed wall part 210 (that is, bulges toward the fixed wall part 210), the volume of the pump chamber 20 decreases. When the deformable part 220*a* moves in a direction separating from the fixed wall part 210 (that is, returns to the original shape due to the elastic recovery), the volume of the pump chamber 20 increases.

Therefore, when the deformable part 220*a* reaches an outermost position (a so-called lower dead point) within its movable range (that is, a range within which the deformable part 220*a* reciprocates in the approaching and separating direction), the volume of the pump chamber 20 is largest, and when it reaches an innermost position (a so-called upper dead point) at which the deformable part 220*a* is located closest to the fixed wall part 210, the volume of the pump chamber 20 is smallest.

Figure 9:
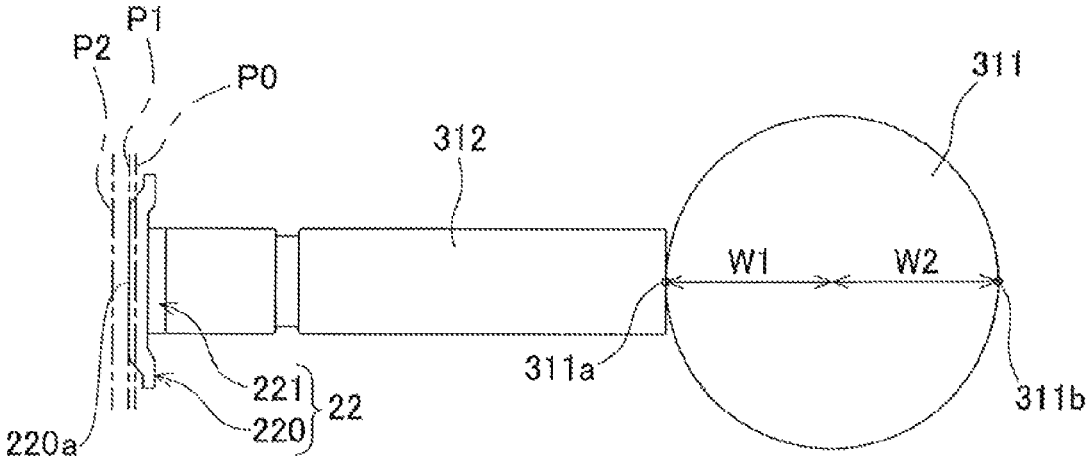
FIG. 9 is an explanatory view of the diaphragm and a cam according to the embodiment.

As shown in FIG. 9, when a position at which the deformable part 220*a* is in the state where it is not elastically deformed is virtually represented as a neutral position P0, an outermost position P1 is set at a position closer to the fixed wall part 210 than the neutral position P0, and an innermost position P2 is set at a position closer to the fixed wall part 210 than the outermost position P1. The configurations of the diaphragm 22 and other members are schematically illustrated in FIG. 9 to FIG. 13.

With the above configuration, the deformable part 220*a* is elastically deformed to constantly bulge toward the fixed wall part 210 in a state where the deformable part 220*a* is incorporated into the diaphragm pump 1. Thereby, the deformable part 220*a* is configured to constantly induce a tension force, and configured so that when the deformable part 220*a* moves in a direction approaching the fixed wall part 210, the tension force increases, while the deformable part 220*a* moves in a direction separating from the fixed wall part 210, the tension force decreases.

When a stress caused to the deformable part 220*a* that has reached its elastic limit is 100%, the stress caused when the deformable part 220*a* has reached the innermost position P2 is set to be equal to or lower than 100%. Thus, the deformable part 220*a* is configured to be elastically deformed within a range within which plastic deformation is unlikely to cause.

In the following description, a direction in which an object moves toward the fixed wall part 210 in the direction toward and away from the fixed wall part 210 is referred to as the approaching direction, and a direction in which an object moves away from the fixed wall part 210 in the direction toward and away from the fixed wall part 210 is referred to as the separating direction. There is a case where the motion toward the fixed wall part 210 is referred to as advancing in the approaching and separating direction, and a motion away from the fixed wall part 210 is referred to as the retracting in the approaching and separating direction.

The connection part 221 is located on one of both sides of the diaphragm body 220, which is opposite to the side facing the fixed wall part 210, and at a central part of the diaphragm body 220.

As shown in FIG. 6, the suction-side valve mechanism 23 includes: a suction-side communication passage 230 that is in communication with the suction-side fluid passage 211; a suction-side ball 231 that is disposed within the suction-side communication passage 230; a suction-side valve seat 232 that is configured to receive the suction-side ball 231 on the upstream side in the suction-side communication passage 230 and switch between a position in contact with the suction-side ball 231 and a position not in contact with the same to switch the suction-side communication passage 230 between the opening state and the closing state; and a suction-side receiving part 233 that is located within the suction-side communication passage 230 and configured to receive the suction-side ball 231 on the downstream side of the suction-side valve seat 232.

A through hole having a diameter smaller than the diameter of the suction-side ball 231 is formed in the suction-side valve seat 232. When the suction-side ball 231 contacts the suction-side valve seat 232, it comes into tight contact with the periphery of the through hole to thereby regulate the circulation of the liquid within the suction-side communication passage 230, that is, close the suction-side communication passage 230.

A plurality of through holes for communication between the inside and the outside of the suction-side communication passage 230 are formed in the suction-side receiving part 233, and the inner diameter of them is smaller than the outer diameter of the suction-side ball 231.

The discharge-side valve mechanism 24 includes: a discharge-side communication passage 240 that is in communication with the discharge-side fluid passage 212; a discharge-side ball 241 that is disposed within the discharge-side communication passage 240; a discharge-side valve seat 242 that is configured to receive the discharge-side ball 241 on the upstream side in the discharge-side communication passage 240 and switch between a position in contact with the discharge-side ball 241 and a position not in contact with the same to switch the discharge-side communication passage 240 between the opening state and the closing state; and a discharge-side receiving part 243 that is located within the discharge-side communication passage 240 and configured to receive the discharge-side ball 241 on the downstream side of the discharge-side valve seat 242.

A through hole having a diameter smaller than the diameter of the discharge-side ball 241 is formed in the discharge-side valve seat 242. When the discharge-side ball 241 contacts the discharge-side valve seat 242, it comes into tight contact with the periphery of the through hole to thereby regulate the circulation of the liquid within the discharge-side communication passage 240, that is, close the discharge-side communication passage 240.

A plurality of through holes for communication between the inside and the outside of the discharge-side communication passage 240 are formed in the discharge-side receiving part 243, and the inner diameter of them is smaller than the outer diameter of the discharge-side ball 241.

Figure 4:
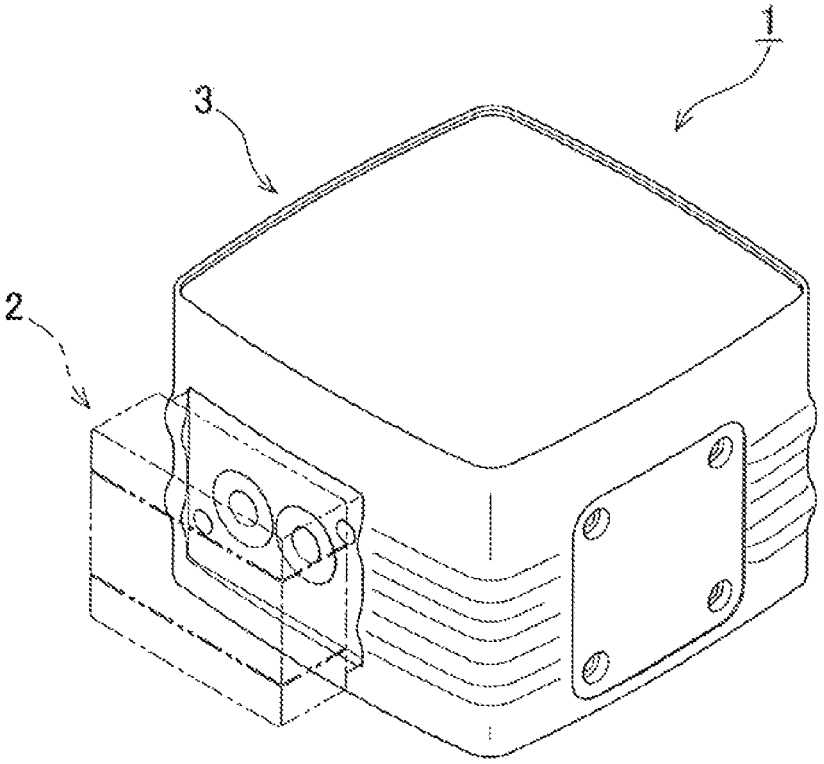
FIG. 4 is a perspective view of a drive unit according to the embodiment.
Figure 5:
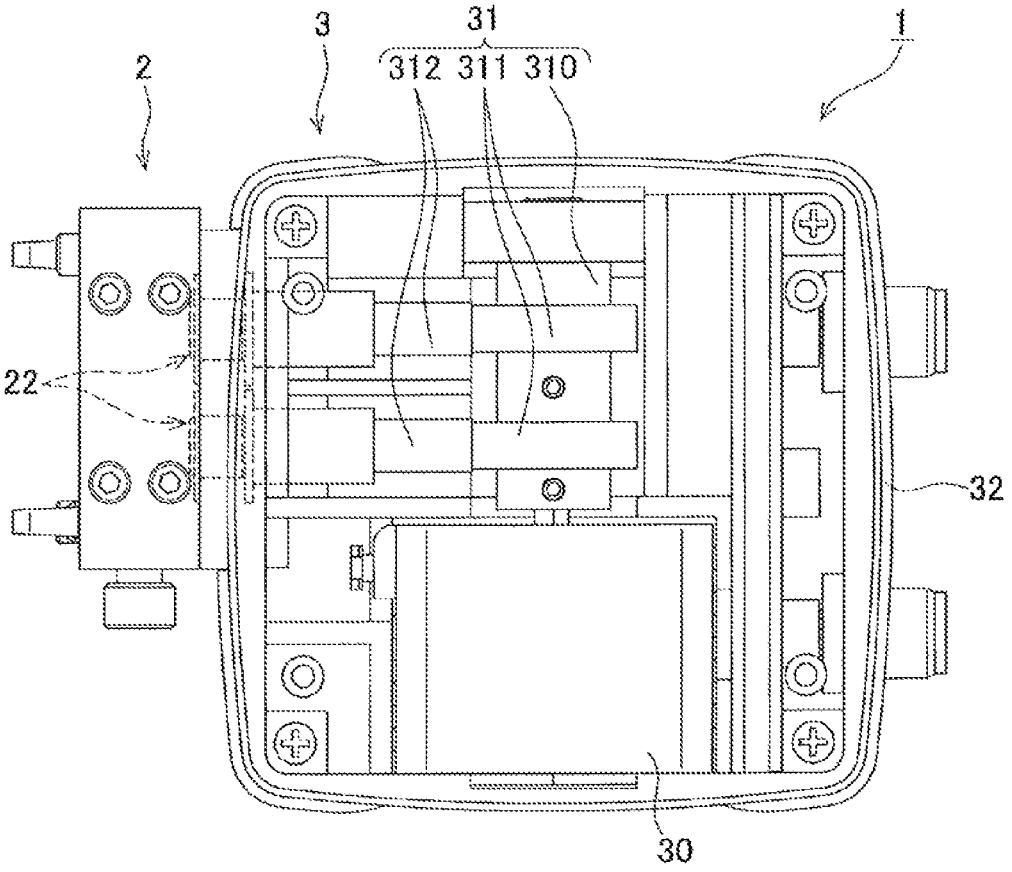
FIG. 5 is a plan view of the drive unit of the diaphragm pump according to the embodiment in a state where an upper side is opened.

As shown in FIG. 5, the drive unit 3 includes a driving source 30 such as an electric motor, a transmission mechanism 31 for transmitting the driving power generated by the driving source 30 to the diaphragm 22, and a case 32 for housing the driving source 30 and the transmission mechanism 31. An outer surface of the case 32 forms an area to be brought into contact with the head unit 2 (see FIG. 4).

The transmission mechanism 31 has a shaft shape and includes: a rotation shaft 310 that rotates about its own center axis by the driving power of the driving source 30; a cam 311 that is mounted to the rotation shaft 310; and a shaft 312 that is located to be in contact with the diaphragm 22 and the cam 311 and is configured to reciprocate in the approaching and separating direction by the rotation of the cam 311.

The cam 311 is configured to support the diaphragm 22 at a position away from the diaphragm 22 toward the retracting side. In this embodiment, the cam 311 is configured to support the diaphragm 22 through the shaft 312. The cam 311 is configured to support on its outer circumferential surface the diaphragm 22 through the shaft 312. As shown in FIG. 9, this outer circumferential surface includes: a rearmost support point 311*a* which acts as a support point of the diaphragm 22 in a state where the diaphragm 22 reaches the outermost position P1; and a foremost support point 311*b* which acts as a support point of the diaphragm 22 in a state where the diaphragm 22 reaches the innermost position P2 (see FIG. 12).

A distance W1 from the rearmost support point 311*a* to the rotational center of the cam 311 is smaller than a distance W2 from the foremost support point 311*b* to the rotational center of the cam 311. The difference between these two distances W1, W2 is smaller than the distance from the neutral position P0 to the innermost position P2 of the diaphragm 22.

The distance from the rotational center to the outer circumferential surface of the cam 311 is set to gradually increase as the support point advances from the rearmost support point 311*a* toward the foremost support point 311*b*.

The shaft 312 has one end in the axial direction held in connection with the connection part 221 of the diaphragm 22, while being not in connection with the cam 311, and another end in the axial direction located to be in contact with the outer circumferential surface of the cam 311. Therefore, the position at which the outer circumferential surface of the cam 311 contacts the other end of the shaft 312 acts as a support point of the diaphragm 22.

In the transmission mechanism 31, when the cam 311 is rotated, the support point displaces in the approaching and separating direction. When the support point displaces in the approaching direction, it is possible to push the deformable part 220*a* toward the fixed wall part 210 through the shaft 312 so that the deformable part 220*a* can advance. When the support point displaces in the separating direction, it is possible to allow the deformable part 220*a* to retract due to the elastic recovery of the deformable part 220*a* without having to apply a tension force to the deformable part 220*a*.

The configuration of the diaphragm pump 1 according to this embodiment is as described above. Next, the operation of the diaphragm pump 1 will be described.

Figure 10:
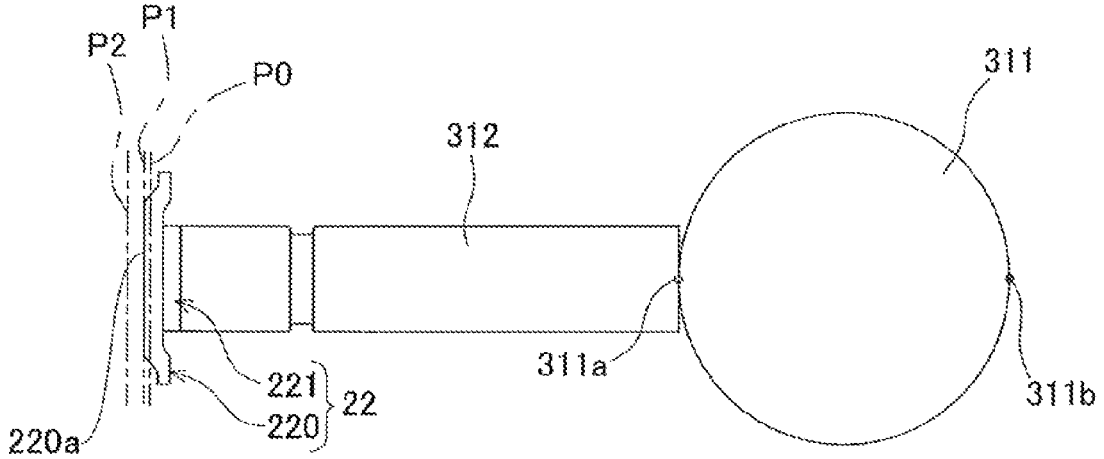
FIG. 10 is an explanatory view of an operation of the diaphragm pump according to the embodiment.
Figure 11:
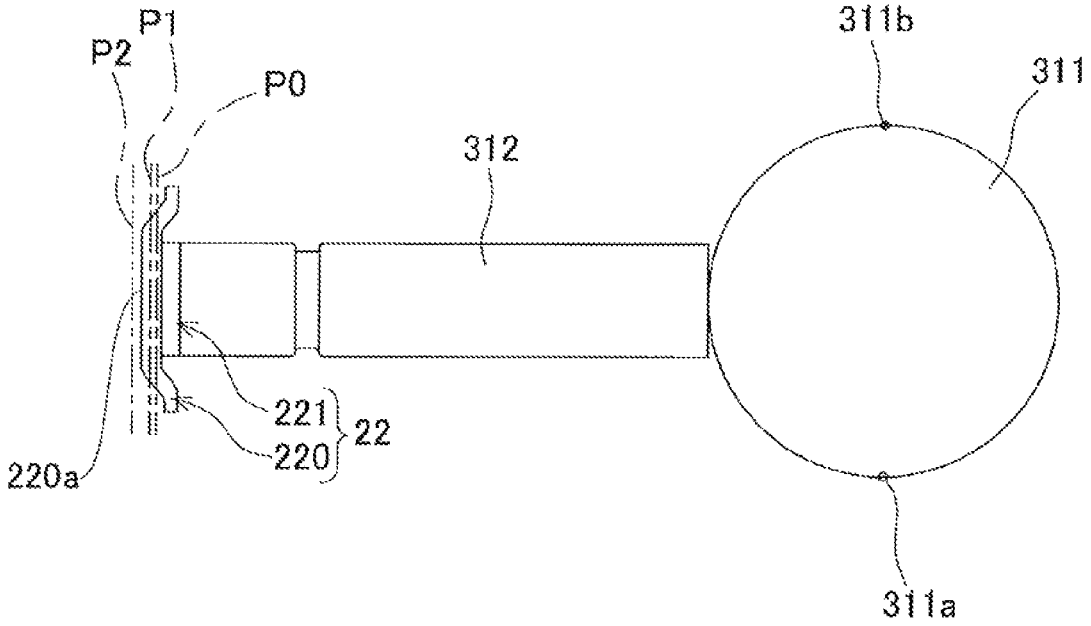
FIG. 11 is an explanatory view of an operation of the diaphragm pump according to the embodiment, in which the diaphragm is moving from a lower dead point toward an upper dead point.
Figure 12:
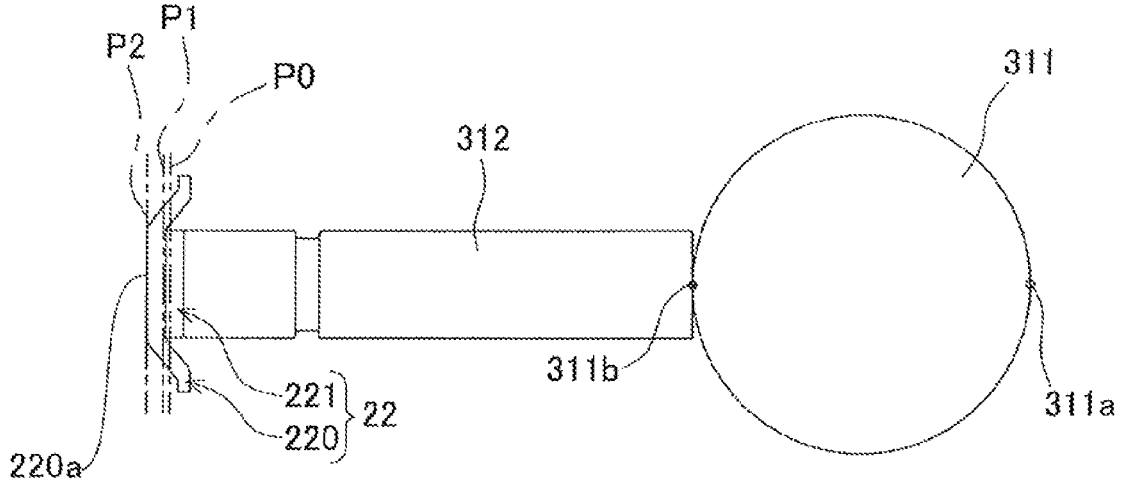
FIG. 12 is an explanatory view of an operation of the diaphragm pump according to the embodiment, in which the diaphragm reaches the upper dead point.

As shown in FIG. 10 and FIG. 11, or FIG. 11 and FIG. 12, in a case where the contact position of the outer circumferential surface of the cam 311 to the other end of the shaft 312 shifts to the foremost support point 311*b* side by the rotation of the cam 311, the support point displaces in the approaching direction, so that the diaphragm 22 moves toward the innermost position P2 and hence the internal volume of the pump chamber 20 decreases. Thereby, the internal pressure of the pump chamber 20 increases so that the discharge-side valve mechanism 24 is opened while the suction-side valve mechanism 23 is closed, and hence the liquid within the pump chamber 20 is discharged from the discharge-side fluid passage 212 to the outside.

Figure 13:
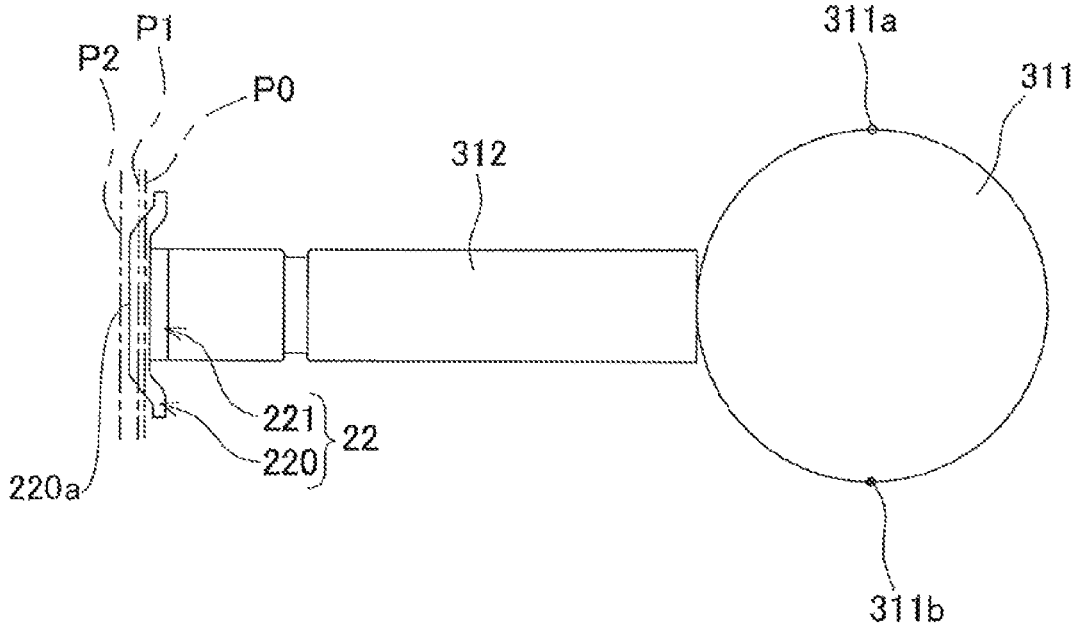
FIG. 13 is an explanatory view of an operation of the diaphragm pump according to the embodiment, in which the diaphragm is moving from the upper dead point toward the lower dead point.

As shown in FIG. 12 and FIG. 13, in a case where the contact position of the outer circumferential surface of the cam 311 to the other end of the shaft 312 shifts to the rearmost support point 311*a* by the rotation of the cam 311, the support point displaces in the separating direction, so that the diaphragm 22 moves toward the outermost position P1 and hence the internal volume of the pump chamber 20 increases. Thereby, the internal pressure of the pump chamber 20 decreases so that the discharge-side valve mechanism 24 is closed while the suction-side valve mechanism 23 is opened, and hence the liquid is allowed to flow from the suction-side fluid passage 211 into the pump chamber 20.

The above operation is repeated so that a certain amount of the liquid can be delivered at every certain time interval.

According to the diaphragm pump 1 of this embodiment, even in the state where the diaphragm 22 reaches the lower dead point, the diaphragm 22 is supported by the drive unit 3 while being deformed toward the inside in the inward and outward direction (toward the inside of the pump chamber 20). Thus, it is possible to maintain the state of inducing a tension force in the diaphragm 22.

Therefore, the tension force of the diaphragm 22 can be opposed to the pressure applied to the diaphragm 22 from the liquid within the pump chamber 20 so that the diaphragm 22 is unlikely to be deformed toward the outside of the pump chamber 20. That is, the diaphragm 22 is unlikely to be deformed toward the outside beyond the lower dead point. This advantageously works particularly for the high pressure liquid.

Accordingly, the diaphragm pump 1 of this embodiment can sufficiently deform the diaphragm 22 by a small driving power toward the inside of the pump chamber 20 at the time of the discharge of the liquid, and thereby the reduction in the discharge amount of the liquid can be suppressed. Since the diaphragm 22 is not deformed toward the outside beyond the neutral position P0, it is possible to suppress the increase of the force required for deforming the diaphragm 22 toward the inside when the liquid is discharged, and thereby produce an excellent effect of being capable of suppressing the deterioration of the liquid discharge efficiency against an external force for deforming the diaphragm 22.

Further, since the deformable part 220*a* of the diaphragm 22 is configured to reach the lower dead point due to its own elastic recovery which causes itself to return to the original shape after it is pushed to the upper dead point by the drive unit 3, the diaphragm pump 1 of this embodiment can move the deformable part 220*a* toward the lower dead point without having to provide a tension mechanism that applies the tension force to the deformable part 220*a* to cause it to move toward the outside (the pulling force in the separating direction).

Therefore, it is possible to reduce the number of parts of the diaphragm pump 1 according to this embodiment. The elimination of the necessity to apply the tension force to the deformable part 220*a* by the drive unit 3 also eliminates the necessity to fix the deformable part 220*a* to the drive unit 3 (e.g., by screwing) so that it is possible to easily dismount the head unit 2 including the diaphragm 22 from the drive unit 3.

The diaphragm pump of the present invention is not necessarily limited to the above embodiment, and can be subjected to various modifications within the gist of the present invention.

In the above embodiment, the deformable part 220*a* of the diaphragm 22 has a flat plate shape, but can be formed to have a corrugate plate shape. Further, as long as the diaphragm 22 in the state of being incorporated into the diaphragm pump 1 is disposed to have the outermost position P1 located inward of the neutral position P0, the diaphragm 22 can be disposed such that the deformable part 220*a* is located inward or outward of the annular edge part 220*b* in the state where an external force is not applied to the deformable part 220*a*, that is, the deformable part 220*a* is not elastically deformed.

REFERENCE SIGNS LIST

1: Diaphragm pump
2: Head unit
3: Drive unit
20: Pump chamber
21: Pump head
22: Diaphragm
23: Suction-side valve mechanism
24: Discharge-side valve mechanism
25: Spacer
30: Driving source
31: Transmission mechanism
32: Case
210: Fixed wall part
211: Suction-side fluid passage
212: Discharge-side fluid passage
213: Arrangement part
214: Contact surface
220: Diaphragm body
220*a*: Deformable part
220*b*: Annular edge part
220*c*: Seal part
221: Connection part
230: Suction-side communication passage
231: Suction-side ball
232: Suction-side valve seat
233: Suction-side receiving part
240: Discharge-side communication passage
241: Discharge-side ball
242: Discharge-side valve seat
243: Discharge-side receiving part
310: Rotation shaft
311: Cam
311*a*: Rearmost support point
311*b*: Foremost support point
P0: Neutral position
P1: Outermost position
P2: Innermost position

The invention claimed is:

1. A diaphragm pump comprising:

a diaphragm that forms a part of a wall part of a pump chamber having a space for housing liquid to be delivered and that is elastically deformable to reciprocate in an inward and outward direction relative to the pump chamber; and a drive unit for elastically deforming the diaphragm toward the inner side in the inward and outward direction, wherein the diaphragm has a lower dead point located inward of a neutral position in the inward and outward direction, in which the diaphragm is not elastically deformed at the neutral position, the drive unit is configured to support the diaphragm on an outer side in the inward and outward direction when the diaphragm lies at the lower dead point after reaching the lower dead point, and the diaphragm is configured to move toward an upper dead point by being pressed toward the inner side in the inward and outward direction by the drive unit, and move toward the lower dead point by elastic recovery due to the elastic force of the diaphragm itself.

* * * * *